US005869182A

United States Patent [19]

Ebert et al.

[11] Patent Number: 5,869,182

[45] Date of Patent: Feb. 9, 1999

[54] SEWING THREAD, AREA STRUCTURE SEWN THEREBY, AND METHOD FOR OBTAINING A SPLASH-PROOF STITCHED CONNECTION

[76] Inventors: Gerd Ebert, Amundsenstr, D-8500 Nurnberg, Germany; Thomas Seitz, Simmonshofer Str; Werner Amler, Ringstr, both of D-8560, Germany

[21] Appl. No.: 331,591

[22] PCT Filed: May 6, 1993

[86] PCT No.: PCT/EP93/01110

§ 371 Date: Jan. 9, 1995

§ 102(e) Date: Jan. 9, 1995

[87] PCT Pub. No.: WO93/22943

PCT Pub. Date: Nov. 25, 1993

[30] Foreign Application Priority Data

May 8, 1992 [DE] Germany ..... 42 15 176.7

[51] Int. Cl.[6] ..... D02G 3/00

[52] U.S. Cl. ..... 428/375; 428/364; 428/372; 428/373; 428/396; 57/258; 57/903

[58] Field of Search ..... 428/372, 373, 428/375, 396, 364; 57/232, 234, 258, 903

[56] References Cited

U.S. PATENT DOCUMENTS

| | | | |
|---|---|---|---|
| 4,593,418 | 6/1986 | Simon | 2/275 |
| 5,420,180 | 5/1995 | Katayama et al. | 428/396 |
| 5,436,075 | 7/1995 | Sawko | 428/375 |
| 5,460,881 | 10/1995 | Hsu | 428/375 |
| 5,486,416 | 1/1996 | Johnson et al. | 428/375 |
| 5,501,879 | 3/1996 | Murayama | 428/372 |
| 5,512,369 | 4/1996 | Goodrich et al. | 428/372 |

FOREIGN PATENT DOCUMENTS

| | | |
|---|---|---|
| 58082750 | 6/1979 | Japan . |
| 61296181 | 12/1986 | Japan . |

*Primary Examiner*—William Krynski
*Assistant Examiner*—J. M. Gray
*Attorney, Agent, or Firm*—Pendorf & Cutliff

[57] ABSTRACT

A sewing thread comprising at least one precursor material of a product at its outer surface, which imparts a stitched connection produced with such a thread an increased adherence to the material to be sewn. Furthermore, the invention provides a sewing thread wherein the applied precursor material transforms to form a product which is capable of enlarging the outer diameter of the sewing thread, particularly in an aqueous environment. Furthermore, the invention provides a method for producing waterproof stitched connections.

24 Claims, 1 Drawing Sheet

SEWING THREAD, AREA STRUCTURE SEWN THEREBY, AND METHOD FOR OBTAINING A SPLASH-PROOF STITCHED CONNECTION

BACKGROUND OF THE INVENTION

1. Field of the Invention

The invention relates to a sewing thread comprising a thread, and a precursor material impregnated into at least the outer surface of the thread, the precursor material capable of being activated after processing of said sewing thread to a product which imparts an increased adherence between the sewing thread and a stitched material in a stitched connection produced with such a thread, a sewable area structure sewn therewith, and a method for obtaining at least splash-proof stitched connections.

2. Description of the Related Art

One essential quality feature of textile stitched connections resides in the way the sewing thread material is locked in the material of the sewable area structure to be attached by means of the stitched connection. In lockstitching, such locking is achieved continuously with each stitch, with the underthread provided on a spool of small capacity locking the upper thread. In chain stitching, merely threads paid out by one or several cones of large capacity are used without being locked in every stitch. Locking the thread in chain stitching is achieved by nothing else but sewing across the ends of the stitched connection. If the stitched connection is damaged at a location between its ends, one pull at the thread consequently causes the entire connection to come undone. For this reason, the use of chain stitching is very limited or disadvantageous under practical conditions where a coming undone of stitched connections is accepted due to a lack of alternatives.

For the rest, lockstitched connections, being of higher quality, require considerable work effort as they do not lend themselves to automation. Once the available underthread on a spool has been used up, spool changes must be carried out manually, such that the sewing procedure has to be interrupted repeatedly, even in terms of several minutes under given circumstances, in order to permit a spool change. If it were possible to use a chain-stitched connection, work could be continued uninterruptedly throughout a whole work day or even longer, such that various automation measures might find application.

Due to the fact that its outer surface may be provided with an increased adhesiveness or adhesive effect after sewing, an adhering of the thread to the stitch linkage and to the textile or material to be sewn results in the area of the needle holes. Hereby the thread is held to each stitch linkage in a manner which is similar to the lockstitch thread being immobilized by the underthread. The resulting security against coming loose of the chain-stitched connection is essentially the same as in the case of a lockstitched connection. The essentially more favorable manufacturing option of the chain-stitched connection may thus also be made use of in cases hitherto requiring lockstitching in order to prevent the connection from coming undone. At the same time, further advantages of chain stitches, such as a higher elasticity in comparison with lockstitches, may be made use of. On the other hand, however, a sewing thread according to the invention may also be utilized for lockstitching if required, e.g. for reasons of looks, wearing comfort, or the like.

As a rule, the increased adhesive effect may most advantageously be achieved by a bonding effect. This allows to attain very high adhesive forces, guaranteeing a durable attachment of threads to the stitch linkages and inside the needle holes.

Furthermore it is known to seal textile stitched connections by covering the stitched connections with adhesive or welting ribbons. This, however, requires a considerable additional expense. Without the use of such additional sealing means, a flaw is in any case created when the thread passes through the needle hole.

DE-A-40 25 291, moreover, discloses a method for producing water or moisture proof stitched connections in sewing woven synthetic or rubber materials, or woven materials coated with synthetic or rubber, or multiple-layer synthetic or rubber materials, which in a given case are reinforced with metal foil, by inserting a body core of synthetic or rubber foil between the parts to be sewn upon sewing and by causing the sealant emanating from the pierced body core to cross-link. In particular, organopolysiloxane masses are used as sealants.

Such a method, however, has the disadvantage that on the one hand, the needle constantly contacts a sealant capable of curing, thereby affecting the precision of the stitched connection over longer sewing periods, and on the other hand results in residues of sealant material on the needle which, upon continued sewing, may cause damage inside the fabric and/or to the needle, or even to the sewing device.

Moreover the method of DE-A-40 25 291 requires more precise positioning of the sealant-filled body cores, particularly hoses, bringing about considerable problems of positioning and corresponding technical expense if stitched connections under given circumstances are several meters in length.

One further disadvantage of this prior art method is founded in the fact that sealant constantly leaks at the needle holes, further favored by the circumstance of the articles to be sewn, as a rule, being positioned between the pressure leg and the bottom feeder, whereby additional pressure is exerted on the tube and its content of sealant, thus causing the sealant to constantly emanate and frequently reach locations of the sewing device and of the article being sewn where the sealant is not welcome or even harmful.

Consequently there is a need to particularly form textile stitched connections between fluid-proof textile materials by means of textile stitched connections which also fulfil the corresponding sealing requirements without essentially expensive additional measures. In such a case, the textile material may often replace synthetic sheets which are sealingly connected to each other by fusing.

SUMMARY OF THE INVENTION

An essential objective of the invention is to furnish a sewing thread enabling the use of chain stitching even in cases where formerly lockstitching had to be utilized in order to lock the sewing thread.

This objective is attained by a sewing thread comprising a thread and a precursor material impregnated into at least the outer surface of the thread, the precursor material capable of being activated after processing of said sewing thread to a product which imparts an increased adherence between the sewing thread and a stitched material in a stitched connection produced with such a thread.

It is thus one further essential objective of the invention to create textile stitched connections which are largely fluid proof, without expensive, separate sealants being required herefor, and a method for obtaining such connections.

These objects are attained by a sewable area structure sewn with the above-described sewing thread, and a method for obtaining at least splash-proof stitched connections using this sewing thread.

BRIEF DESCRIPTION OF THE DRAWINGS

Further advantages and features of the present invention are obvious from the description of a further embodiment and from the drawing, wherein.

DETAILED DESCRIPTION OF THE INVENTION

Figure 1:
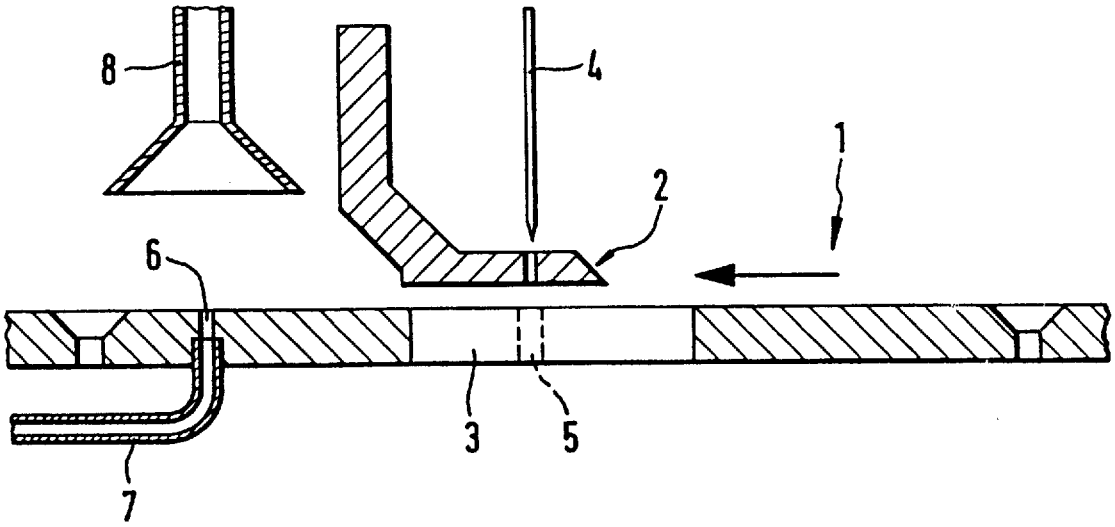
FIG. 1 shows a longitudinal sectional view of part of a device for implementing the method according to the invention.

The sewing thread comprises, at least at its outer surface, at least one precursor material which converts to a product which increases the outer diameter of the sewing thread after sewing by activating a property which increases the actual or apparent volume, said activation excluding a foaming process, characterized in that said precursor material is selected from the group consisting of:

polysaccharides, polysaccharide products insoluble in cold water; esters of polysaccharides and inorganic acids, esters of polysaccharides and organic acids; polysaccharide ethers; starches, potato starches; esters of starches and inorganic acids, esters of starches and organic acids; starch ethers, starch ethers containing nitrogen, cationic starch ethers, in particular salts thereof; acrylamides, N and C substituted acrylamides, or acrylamide oligomers; polytetrafluoroethylene mixed with an expandable material; molecules capable of causing changes of volume due to conformational changes; inorganic expandable materials such as expandable perlite, expandable mica, or expandable graphite; as well as mixtures thereof.

The above-mentioned molecules may be selected from the group consisting of natural or synthetic heteropolymers, in particular peptides or proteins; and natural or synthetic homopolymers, in particular polysaccharides.

The precursor material may more specifically be selected from the group consisting of:

silicone resins; alkyl silicone resins, methyl silicone resins; aryl silicone resins; copolymers of vinyl chloride and vinyl acetate; polysaccharides, polysaccharide products insoluble in cold water; esters of polysaccharides and inorganic acids, esters of polysaccharides and organic acids; polysaccharide ethers; starches, potato starches; esters of starches and inorganic acids, esters of starches and organic acids; starch ethers, starch ethers containing nitrogen, cationic starch ethers, in particular salts thereof; acrylamides, N and C substituted acrylamides, or acrylamide oligomers; as well as mixtures thereof.

The sewing thread may contain additional additives selected from the group consisting of:

common impregnations for threads; natural and synthetic waxes; paraffins; cross-linkers for growing polymer chains, in particular methylene bisacryloamide or N,N,N',N'-tetramethyl ethylene diamine; plastifiers, in particular dibutyl phthalate, glycerol; inorganic fillers, organic fillers; primers; radical starters, peroxides, organometallic compounds, in particular organoaluminum compounds; as well as suitable mixtures thereof.

Preferably, the precursor material is acrylamide; and preferably the additives are methylene bisacryloamide and N,N,N',N'-tetramethyl ethylene diamine, as well as glycerol.

When the actual volume is increased, density drops, such that this same material occupies a larger space. When the apparent volume is increased, the material changes its shape in the microscopic area such that, when seen macroscopically, the impression of an increased volume is created.

The amount of the volume change is to be devised such that the needle hole for the thread created during sewing is filled and, as it were, stopped by the expansion. Diameter increases ranging from 20% to 200% are sufficient herefor, preferably from 30% to 150%, and in particular from 40% to 100%. With most materials, the best results are achieved with diameter increases ranging from 50% to 80%.

For the volume change to be effected, a variety of measures are available. For example, the outer coat of the thread may be formed by a foamable synthetic as discussed above which, after the thread was processed in the stitched connection, is foamed in the usual manner through the influence of temperature and/or catalysts. The foaming ratio may herein be kept low, e.g. lower than 1:2, such that nevertheless a relatively solid surface of the expanded thread is obtained. As the thread is provided in an unfoamed form during processing, neither the foaming process nor a foamed consistency of the thread obstruct its processing in the sewing process.

Furthermore the use of other inorganic expandable materials, in particular of expandable perlite, expandable mica, or expandable graphite, may be considered. Particularly the use of expandable graphite simultaneously brings about a desirable, friction reducing influence on the thread surface which facilitates processing of the thread during the sewing process.

Particularly in the area of larger thread diameters it is known to carry out a coating of the thus obtained strings by means of polytetrafluoroethylene. Here the invention may be used by applying the polytetrafluoroethylene in a mixture with an expandable material, with the expandable material being expanded after processing by means of a corresponding influence causing an expansion.

Finally it is conceivable to use chemical changes in the condition of a surface coating for volume increases. In this context it may be considered to use molecules which are able to bring about volume changes due to conformational changes. Such molecules may be selected e.g. from the groups of natural or synthetic heteropolymers, in particular peptides or proteins; natural or synthetic homopolymers, in particular polysaccharides.

In order to increase the apparent volume, the surface may be formed by a textile fiber material which may e.g. be applied by covering a core by spinning, with the core consisting of a non-elastic material. Here the external threads may be chosen to be of a material presenting the known "memory" effect, such that in the relaxed "final" state, a considerable deviation of the longitudinal fiber axis from a straight line will be given. Thus, for example, crimped fibers may be used for external fibers. These are, however, applied loosely in a stretched form, i.e. without any tractional tension and having slack, and then brought into the crimped shape or the like by activating the "memory" effect after processing. This does not cause a change of volume properly speaking, but an apparent change of volume which resembles an actual change of volume when seen macroscopically. One may resort to this particularly if the requirements made to sealing are not excessively high, or particularly if an increased friction of the thread is to be achieved inside the needle hole.

It is essential to process the thread in its non-expanded state and to have the volume increase occur subsequently, after the thread was processed in the stitched connection. In a given case, if activation brings about the expansion only after a corresponding delay, it may also be triggered before processing.

Certain measures present the advantage that a multiplicity of precursor materials are available which may physically or chemically be transformed into the respective products, with these products presenting the properties of increasing their volume as compared to their precursor materials, and imparting the sewing thread with good adhesion to the sewn articles.

Furthermore a physical transformation may, however, also consist of transforming, e.g. thermally transforming, an insoluble material, e.g. starch, into a soluble material, with this material then presenting the desired properties of adhesiveness, sealing capability and/or swellability.

By means of the additional auxiliary substances, it is for one thing possible to bring about a chemical activation treatment of the precursor materials, such as polymerization, i.e. a growth of the molecular chains. As a rule, such a polymerization brings about volume increases—beside the adhesive effect—in the materials according to the invention.

On the other hand, the auxiliary substances make it possible to adjust further properties, such as e.g. plasticity, smoothness, sliding capability, residual water content etc.

In a particularly preferred manner, the increased adhesive friction at the exposed thread surfaces which are not in contact with the material to be sewn lessens after a period of several days at the most, in particular of a few minutes at the most. The precursor material is preferably acrylamide; and additives preferably include methylene bisacryloamide and N,N,N',N'-tetramethyl ethylene diamine, as well as glycerol. The adhesive effect at exposed thread surfaces is deactivated after a period of several days at maximum. What is achieved hereby is that, when the sewn fabric is used according to purpose, stickiness does not occur on the surface in the area of the stitched connection, but a corresponding setting has occurred, such that it will not present an increased adhesive effect any more. In accordance with the requirements of production, it may, however, be advantageous to allow a considerably shorter period for this deactivation, for example only several minutes or even seconds in order to preclude a subsequent obstruction of the following work processes due to the stitched connection being sticky toward the outside. In any case, however, the adhesive or bonding effect continues to prevail in those areas where the thread surface contacts other thread surfaces or surfaces of the sewn fabric, such that the adhesive or bonding effect is maintained there without a change or more strongly after setting.

An advantageous system is one where acrylamide is used as a precursor material which in addition, as additives, contains the cross-linkers methylene bisacrylamide and N,N,N',N'-tetramethyl ethylene diamine as well as the plastifier glycerol.

A sewing thread provided with such a precursor material presents the advantage that the acrylamide may easily be polymerized into polyacrylamide, e.g by means of ultraviolet light and/or peroxides. After sewing, the thread releases water in the course of one or several days. The glycerol, however, retains a residual water content, such that the sewing thread obtains a plastic consistency after sewing e.g. into a chain-stitched connection, whereby it becomes relatively sticky and adheres well to the sewn articles and to the needle holes. Whenever the finished textile comprising the stitched connection thus obtained is subjected to increased humidity, such as a rain shower, the polyacrylamide gel is made to swell up again through absorption of water, such that the needle holes are filled by the polymer and thus stopped to become waterproof. Hereby a virtually "intelligent stitched connection" is furnished according to the invention, which reversibly swells up in particularly humid environments and shrinks again in dry surroundings—without, however, relinquishing its good adhesion to the sewn articles.

A similar effect may be achieved if starches which are insoluble in cold water, in particular potato starches, are used as a precursor material, thermally transformed into a solution after the sewing process, e.g. by water steam,—in a given case admixed with bactericide or fungicide agents before processing for protection against microbiological decomposition—whereby a polysaccharide film forms on the sewing thread and in the vicinity of the needle hole. This film possesses a bonding property similarly to wallpaper glue, and analogously to the polyacrylamide system it is able to reversibly absorb water and swell.

Textiles sewn with such a stitched connection may also be laundered at temperatures of approximately 40° to 60° C. without the starch/precursor material being dissolved, as the latter comprises a starch insoluble in cold water which is not dissoluble yet in the indicated temperature range.

In principle, possible materials for the two-dimensional area structures to be connected are any textile fabrics and foils etc. such as also paper, leather and the like, which are furnished so as to be fluid proof. Especially preferred, however, are natural substances which can be disposed of without problems, or which furthermore are useful when disposed of, such as by use as fodder or the like. Particularly suited in this sense are textile fabrics on the basis of organic, reproductive fibers such as flax, linen or sea weed or the like, which may be processed or rendered fluid proof in any desirable manner. One possibility of fluid proof sealing without the use of synthetic substances is e.g. sealing by means of bees' wax.

Frequently it will also be required for establishing complete closeness, also between textile layers to be connected, to feed a welting ribbon or the like and to sew it in at the stitched connection. This welting ribbon may consist of the same material as the one of the sewing thread, and thus e.g. also be expanded following its processing in order to produce additional sealing pressure. In a given case, this welting ribbon may, however, also consist of another material, in particular a soft, elastic one which is compressed during the sewing process and thereby produces the sealing pressure. In this regard, possible welting ribbons consist of latex, soft rubber or the like.

Thus the expansion of the sewing thread after processing makes possible a drastic increase of the thread friction inside the needle hole, and thereby a self-clinging effect at interrupted thread line. This may above all be utilized for an essentially increased scope of the use of chain-stitched connections, without the risk of an incompletely locked chain thread or a broken chain thread causing the entire stitched connection to come undone. In such a case of a broken thread, the adjacent needle holes hold the thread and thereby prevent it from getting loose, and the entire stitched connection from coming undone. As chain-stitched connections are commonly known to be produced without a spool thread, the necessity of feeding a spool thread which is wound on spools in a very limited length and thus leads to frequent interruptions of the sewing process in order to change spools is thereby eliminated. This self-locking or self-holding effect of the sewing thread according to the invention in context with chain-stitched connections thus opens considerably wider areas of application for the chain-stitched connections which are more favorable with regard to production technology.

In this regard, a thread whose volume is increased after sewing, e.g. a swelling one, allows to obtain an advantage with regard to wider applicability or avoiding disadvantages of chain-stitched connections, which is similar to the one of the sewing thread having a surface with an increased adhesive effect. Needless to say, combined application of both of these measures, i.e. surface increase and an increased adhesive effect, in particular a sticking effect, is of particular advantage as it not only intensifies the clinging effect of the chain-stitched connection thread at the stitched linkages, or in the needle holes, but furthermore adhering of the sewing thread provides an additional contribution to sealing. Sealing against water may particularly be supported in that the thread capable of adhering is hydrophobised. In turn, however, the sewing thread having a surface of increased adhesiveness as well as the swellable sewing thread may be used in a lockstitched connection, in case this should be desired or required in a single case. Swelling capability also brings about a corresponding seal in the context of a lockstitched connection, while the adhesive effect further intensifies locking, also of a lockstitched connection; this may be of interest if, for instance, a structure provided with such a stitched connection is to be subdivided into many small structures, each of which is to be held by a short portion of the stitched connection.

Even if a stitched connection comprising a spool thread is used, however, an advantage is created by the fact that, due to a smaller thread thickness before processing, a considerbly greater length of thread may be stored on the spool, thereby allowing a reduction of the number of work interruptions. After processing, i.e. during use, the thread is nevertheless provided in a greater thickness, which is desired in order to obtain a more favorable tearing behavior or for other reasons.

The thread core may consist of any suitable non-elastic material that is compatible with the material of the expandable surface layers. Thus cotton, KEVLAR, carbon fibers or glass filaments may be used as a core material. The core need, however, not necessarily consist of a material different from the surface layers, as long as the expansion effect is definitely limited to the surface layers.

EXAMPLE 1

In order to produce a stitched connection which is at least splash-proof, a commercially available sewing thread is conducted through an aqueous solution of a silicone resin serving as the precursor material. As the silicone resin, commercially available "Silikonharz MK" of Wacker-Chemie AG is used. After passing the immersion bath or a sponge saturated with the silicone resin solution, the sewing thread is fed to the sewing device and e.g. parts of motorcycle garment as the articles to be sewn are sewn by means of this thread.

The stitched connection thus produced undergoes an activating treatment in that a commercially available setting agent, in an exemplary case an organoaluminum compound commercially available under the designation "F100%" of Wacker-Chemie, is applied to the freshly stitched connection by means of a spray nozzle. By applying the setting agent onto the stitched connection, the silicone resin precursor material is transformed into a high polymer silicone resin which, on the one hand, gives the stitched connection an increased adhesion to the sewn articles, and on the other hand renders the needle holes of the stitched connection essentially water-proof, with bonded seal being emphasized here beside the expanding effect.

Here the waterproof property essentially results from the bonding properties of the silicone resin which coats the thread inside the needle hole and then sets or cross-links and adheres to the sewing thread as well as to the sewn article.

EXAMPLE 2

A commercially available sewing thread, e.g. a cotton thread just like in Example 1 is conducted through an aqueous solution of a copolymer of vinyl chloride and vinyl acetate and a plastifier, diphenyl phthalate in an exemplary case. Subsequently the thread thus impregnated is fed to a sewing device, in an exemplary case a commercially available industrial sewing machine.

Herein the copolymer of vinyl chloride and vinyl acetate, having the form of an aqueous dispersion with cellulose as a stabilizer, serves as a precursor material, and in an exemplary case, "Vinnol-Dispersion 50/25C" distributed by Wacker-Chemie AG is used. At the sewing machine, a rain protection garment of a synthetic material is sewn with the sewing thread in a chain-stitched connection. Subsequently, the stitched connection is subjected for a short period to a high-frequency treatment, in particular a microwave treatment, as an activating treatment. Here it is of advantage to furthermore add microwave absorbers such as soot, graphite, or conductive metal oxides or the like to the dispersion. By this kind of activating treatment, the precursor material, in an exemplary case the copolymer of vinyl acetate and vinyl chloride, is transformed into a product presenting good bonding and sealing properties, whereby the needle holes of the stitched connections are at least made splash-proof, such that e.g. a motorcycle rider wearing such rain protection garment need not fear water to penetrate at the needle holes.

EXAMPLE 3

During its processing into a stitched connection, a commercially available cotton sewing thread is conducted through an aqueous solution of an acrylamide and methylene-bisacrylamide and N,N,N',N'-tetramethylethylene diamine as additives forming cross-links, as well as glycerol as a plastifier.

The thread thus treated is then fed to an industrial sewing machine, and the article to be processed by sewing is sewn by using this thread in a chain-stitched connection.

Then an activating treatment is carried out by spraying an aqueous solution of ammonium peroxide onto the stitched connection and additionally irradiating it with an ultra-violet lamp.

By means of this activating treatment, the acrylamide, or possibly present acrylamide oligomers, are transformed into a gel-like polymer product by cross-linking with methylene-bisacrylamide and N,N,N',N'-tetramethylethylene diamine. Such a polymer product on the one hand presents the sewing thread with good adhesion to the sewn article in the area of the needle holes, and on the other hand, an "intelligent stitched connection" is provided by this system, as the stitched connection material will initially release water in relatively dry surroundings at ambient temperature, which however is possible only up to a certain degree as the glycerin has an additional water-retaining function apart from its property as a softening agent, whereby an altogether plastic consistency and a good adhesive effect of the sewing thread to the sewn articles is achieved. If e.g. a motorcyclist whose rain protection garment was sewn with the sewing thread according to the invention encounters rain, the sewing thread will swell to the tenfold of its original volume under dry conditions, with the intensive expansion inside the needle holes resulting in particularly good closeness, such that the rainwater will not be able to penetrate through the needle holes.

As soon as the stitched connection is again subjected to normal ambient humidity, it again releases water and thus shrinks—without, however, losing its adhesive effect—such that the original condition is essentially reconstituted, whereas upon renewed exposition to water the sewing thread will swell again. This means that a reversible water release/absorption cycle ensuring closeness of the stitched connection holes as well as of the sewing thread adhering to the sewn article is provided.

The present invention is, of course, also suited for mass-producing a sewing thread according to the invention, with the raw thread being impregnated with a solution of the impregnating agent common in this field while adding the precursor materials and/or additives according to the invention.

Here it is also possible to add microwave absorbers, e.g. graphite, soot or conductive metal oxides to the impregnating agent, such that transformation of the precursor material into the product having the desired properties may preferably be carried out by microwave absorption.

Figure 2:
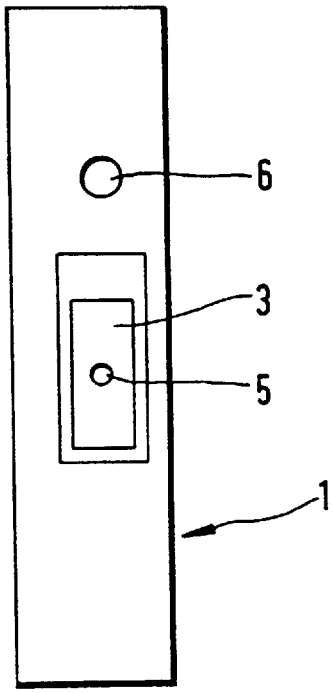
FIG. 2 shows a plan view of part of a device for implementing the method according to the invention.

In FIGS. 1 and 2, the so-called needle plate of an industrial sewing machine (not shown here) is shown under 1 in longitudinal sectional view and plan view, respectively. Here the article being sewn is conveyed in the direction indicated by the arrow. A pressure leg 2 presses the article being sewn (not shown here) against a bottom feeder 3, whereby the article being sewn moves in the direction of the arrow in FIG. 1. A needle 4 of the industrial sewing machine makes a sewing thread (not shown here) penetrate through the article to be sewn, with the needle 4 penetrating the needle plate 1 via a needle hole 5. Due to predetermined needle movement and/or feeding and/or thread feeding, the kind of the desired stitched connection is produced, for example a chain-stitched connection.

If, for example, a thread provided with a dispersion of a starch which is insoluble in cold water is fed to the needle 4, the stitched connection being produced is directed towards an output opening 6. This output opening is, for example, provided with water steam via a conduit 7, whereby the starch which is insoluble in cold water and represents a precursor material is transformed into a product having a sticky consistency. The product thus imparts the stitched connection an increased adhesiveness to the article being sewn and simultaneously seals the needle holes of the stitched connection such that the stitched connection is made essentially waterproof. Furthermore the resulting starch product can absorb additional water after drying, e.g. in rain protection garment for motorcyclists, whereby the sewing thread of the stitched connection swells and the needle holes in the sewn article are particularly well sealed by expansion.

In an exemplary case, excessive water steam may be evacuated via a steam extractor 8.

It is, of course, also possible to provide the output opening 6 e.g. with an additional spray nozzle for other additives, e.g. such causing the polymerization of a monomer which was applied onto the thread to be sewn, whereby the desired properties are also obtained.

Now that the invention has been described,

We claim:

1. A sewing thread comprising:

a thread, and a precursor material impregnated at least partway into said thread, said sewing thread capable of being sewn into a material, said precursor material capable of being activated and converting after its activation to a product which imparts an increased adherence between the sewing thread and the stitched material in the stitched connection produced with such a thread and which increases the outer diameter of the sewing thread by activating a property of the precursor material which increases the actual or apparent volume, said activation excluding a foaming process, and wherein said precursor material is selected from the group consisting of:

polysaccharides, acrylamides, silicone resins, and starches, polytetrafluoroethylene mixed with an, an expandable material, and inorganic expandable materials, and mixtures thereof.

2. A sewing thread in accordance with claim 1, wherein said polysaccharides are selected from the group consisting of unmodified polysaccharides, polysaccharide products insoluble in cold water, esters of polysaccharides and inorganic acids, esters of polysaccharides and organic acids, polysaccharide ethers, unmodified starches, potato starches, esters of starches and inorganic acids, esters of starches and organic acids, starch ethers, starch ethers containing nitrogen, and cationic starch ethers and salts thereof;

wherein said acrylamides are selected from the group consisting of acrylamides, N and C substituted acrylamides, and acrylamide oligomers; and wherein said inorganic expandable materials are selected from the group consisting of expandable perlite, expandable mica, and expandable graphite.

3. A sewing thread in accordance with claim 1, wherein said increase in diameter is within the range of from 20% to 200%.

4. A sewing thread in accordance with claim 1, wherein said increase in diameter is within the range of from 30% to 150%.

5. A sewing thread in accordance with claim 1, wherein said increase in diameter is within the range of from 40% to 100%.

6. A sewing thread in accordance with claim 1, wherein said increase in diameter is within the range of from 50% to 80%.

7. A sewing thread in accordance with claim 1, wherein said precursor material is a material which converts to a product which increases the outer diameter of the sewing thread after sewing by activating a property which increases the actual or apparent volume, said activation excluding a foaming process, and wherein said precursor material is formed of molecules capable of causing changes of volume due to conformational changes and selected from the group consisting of natural heteropolymers, synthetic heteropolymers, natural homopolymers, and synthetic homopolymers.

8. A sewing thread in accordance with claim 7, wherein said heteropolymers are peptides or proteins and wherein said homopolymers are polysaccharides.

9. A sewing thread in accordance with claim 1, wherein said thread comprises a core consisting of non-elastic material.

10. A sewing thread as in claim 1, wherein said sewing thread includes a material which increases the adhesiveness of said thread after said activation.

11. A sewing thread in accordance with claim 10, wherein the increased adhesiveness of said thread after sewing into material and after said activation diminishes at the exposed thread surfaces which are not in contact with the material after a period of several days after sewing.

12. A sewing thread in accordance with claim 10, wherein the increased adhesiveness of said thread after sewing into material and after said activation diminishes at the exposed thread surfaces which are not in contact with the material after a few minutes after sewing.

13. A sewing thread in accordance with claim 1, wherein said precursor material is at least one substance capable of being activated physically and/or chemically.

14. A sewing thread in accordance with claim 1 wherein said thread contains additional additives selected from the group consisting of:

natural and synthetic waxes;

cross-linkers for growing polymer chains;

plastiziers;

inorganic fillers, organic fillers;

primers;

radical starters; and suitable mixtures thereof.

15. A sewing thread in accordance with claim 14, wherein said natural and synthetic waxes are selected from paraffins;

wherein said cross-linkers for growing polymer chains are selected from methylene bisacryloamide and N,N,N',N'-tetramethyl ethylene diamine; and wherein said radical starters are selected from peroxides, organometallic compounds, and organoaluminum compounds.

16. A sewing thread in accordance with claim 14, wherein said plasticizers are selected from the group consisting of dibutyl phthalate and glycerol.

17. A sewing thread in accordance with claim 1 wherein the acrylamides are selected from the group consisting of acrylamide, N and C substituted acrylamides, and acrylamide oligomers.

18. A sewing thread in accordance with claim 1 wherein the polysaccharides are selected from the group consisting of polysaccharide products insoluble in cold water, esters of polysaccharides and inorganic acids, esters of polysaccharides and organic acids, and polysaccharide ethers.

19. A sewing thread in accordance with claim 1 wherein the silicone resins are selected from the group consisting of alkyl silicone resins, methyl silicon resins, and aryl silicone resins.

20. A sewing thread in accordance with claim 1 wherein the starches are selected from the group selected from potato starches, esters of starches and inorganic acids, esters of starches and organic acids, starch ethers, starch ethers containing nitrogen, cationic starch ethers, and salts thereof.

21. A sewing thread in accordance with claim 1 wherein said inorganic material are selected from the group consisting of expandable perlite, expandable mica, and expandable graphite.

22. A sewing thread comprising:

a thread, and a precursor material impregnated at least partway into said thread, said sewing thread capable of being sewn into a material, said precursor material capable of being activated and converting after its activation to a product which imparts an increased adherence between the sewing thread and the stitched material in the stitched connection produced with such a thread and which increases the outer diameter of the sewing thread by activating a property of the precursor material which increases the actual or apparent volume, said activation excluding a foaming process, and wherein said precursor material is formed of molecules capable of causing change of volume due to conformational changes and selected from the group consisting of natural hetropolymers, synthetic hetropolymers, natural homopolymers and synthetic homopolymers.

23. A sewing thread comprising:

a thread, and a precursor material impregnated at least partway into said thread, said sewing thread capable of being sewn into a material, said precursor material capable of being activated and converting after its activation to a product which imparts an increased adherence between the sewing thread and the stitched material in the stitched connection produced with such a thread and the stitched material in the stitched connection produced with such a thread and which increases the outer diameter of the sewing thread by activating a property of the precursor material which increases the actual or apparent volume, said activation excluding a foaming process, wherein said precursor material is selected from the group consisting of:

copolymers of vinyl chloride and vinyl acetate.

24. A sewing thread comprising:

a thread, and an acrylamide precursor impregnated at least partway into said thread, said sewing thread capable of being sewn into a material, said precursor material capable of being activated and converting after its activation to a product which imparts an increased adherence between the sewing thread and the stitched material in the stitched connection produced with such a thread and excluding a foaming process, wherein said thread contains additives selected from the group consisting of methylene bisacrylamide, N,N,N',N'-tetramethyl ethylene diamine, and N,N,N',N'-tetramethyl ethylene diamine.

* * * * *